United States Patent [19]

Yamamura et al.

[11] 4,069,816

[45] Jan. 24, 1978

[54] SHOULDER PATTING INSTRUMENT

[75] Inventors: Yukio Yamamura; Shojiro Kawaguchi; Otohiko Terashima; Tutomu Ichinomiya; Shinpei Otuka, all of Hikone, Japan

[73] Assignee: Matsushita Electric Works, Ltd., Osaka, Japan

[21] Appl. No.: 666,758

[22] Filed: Mar. 15, 1976

[30] Foreign Application Priority Data

Apr. 12, 1975 Japan ..... 50-44668

[51] Int. Cl.[2] ..... A61H 1/00

[52] U.S. Cl. ..... 128/41; 128/55; 128/69

[58] Field of Search ..... 128/41, 55, 52, 24.2, 128/68, 69, 24.1

[56] References Cited

U.S. PATENT DOCUMENTS

| | | | |
|---|---|---|---|
| 1,123,639 | 1/1915 | Wise | 128/41 UX |
| 2,021,968 | 11/1935 | Scheidegger | 128/41 X |
| 2,253,267 | 8/1941 | Dietrich | 128/41 UX |
| 2,441,686 | 5/1948 | Cohen | 128/41 |
| 2,544,248 | 3/1951 | Ashmead | 128/41 X |
| 2,674,995 | 4/1954 | Marino | 128/41 |
| 2,837,084 | 6/1958 | Brumek | 128/24.1 |

*Primary Examiner*—Lawrence W. Trapp

*Attorney, Agent, or Firm*—Leydig, Voit, Osann, Mayer, Holt, Ltd.

[57] ABSTRACT

An instrument for giving patting treatment to a user's shoulder or the like body part to promote blood circulation in stiffened muscle. In a housing of the instrument's body having an aperture, stationary electromagnet part defining an axial space is fixed aligning the space with the housing aperture and freely movable plunger is disposed to extend in the axial space so that, as electromagnetically attracted at an end inside the housing to a magnetized core end due to energization of coil of the stationary electromagnet part, the plunger extracts out of the housing with the other end located in the housing aperture and having a treating attachment with which the instrument is butted to the body part substantially vertically with its weight applying to the latter through the attachment, so as to raise the instrument's body relatively upward and, upon de-energization of the coil, the instrument's body falls down to hit upon the attachment to give the patting treatment to the body part. Continuous supply of intermittent source current to the coil performs continuous pattings.

4 Claims, 18 Drawing Figures

1
2
3
5
6
7
8
9
10
11
12
13
15
16
a
b
A
II

SHOULDER PATTING INSTRUMENT

This invention relates to a shoulder patting instrument and, more particularly, to an instrument for patting stiffened shoulder or the like body part whereby light beating forces are applied to the muscle of the shoulder or the like part of a user's body to improve blood circulation and to cure fatigue.

As instruments similar in the purpose as well as structure and operation to the shoulder patting instrument of the kind referred to, there have been suggested electric massaging instruments of a motor-driven type wherein an electric motor is employed and an electromagnetically-driven type wherein an electromagnetic force is utilized. The motor-driven type requires a mechanism for converting rotary motion of the motor to a reciprocal motion and is therefore accompanied with such defects that the structure is complicated and the noise is high. As of the electromagnetically-driven type, there is suggested, for example, French Pat. No. 1,119,040 wherein an armature is provided movably in an electromagnet employed so that the armature attracted by an energization of the electromagnet will be returned upon de-energization of the electromagnet to the original position by means of a spring and the user's body part will be irritated or excited by the returning force of the armature. Therefore, it is necessary to enlarge the spring force in order to elevate the irritation to the body part and, therefore, there is a defect that, if the spring force is enlarged, a large electromagnetic force will be required in order to attract the armature against the spring force. The present invention is to provide a shoulder patting instrument wherein such defects such as described above are removed.

According to the present invention, such defects as are seen in the above referred electric massaging instruments have been successfully solved in such that a plunger is assembled to the electromagnet fixed to a housing so as to be axially movable and extruded out of housing at an end with which the plunger is to be butted against the shoulder or the like body part to apply thereto the weight of the whole device in use so that, when the electromagnet is energized, the plunger will be attracted to cause the housing and electromagnet therein to be relatively moved away from the body part with respect to the plunger remained in the position butted against the body part and, when the electromagnet is de-energized, the housing and electromagnet will drop so as to perform a shoulder patting operation with their weight and attraction reaction of the electromagnet.

A primary object of the present invention is to provide a shoulder patting instrument which is capable of providing a large impact forces by using a small electromagnet.

Another object of the present invention is to provide a shoulder patting instrument wherein the impact sound generated at the time of attracting the electromagnet is reduced to give no unpleasant sound to the user.

A further object of the present invention is to provide a shoulder patting instrument wherein the shoulder patting period can be freely adjusted.

Another object of the present invention is to provide a shoulder patting instrument whereby the operation is easy and the user's any desired body parts such as the back, shoulders and the like can be patted.

Further objects and advantages of the present invention shall become clear upon reading the following disclosures, in which a most preferable embodiment of the present invention shall be explained in detail with reference to accompanying drawings, in which:

FIGS. 7A, 7B and 7C are fragmentary detailed views of an electromagnet fitting part of the housing of the shoulder patting instrument shown in FIG. 2, in which FIG. 7A is an upper surface view of a lower case, FIG. 7B is a sectioned view of the same, and FIG. 7C shows the lower case as fitted with the stationary part of the electromagnet;

Figures 1, 2A, 2C:
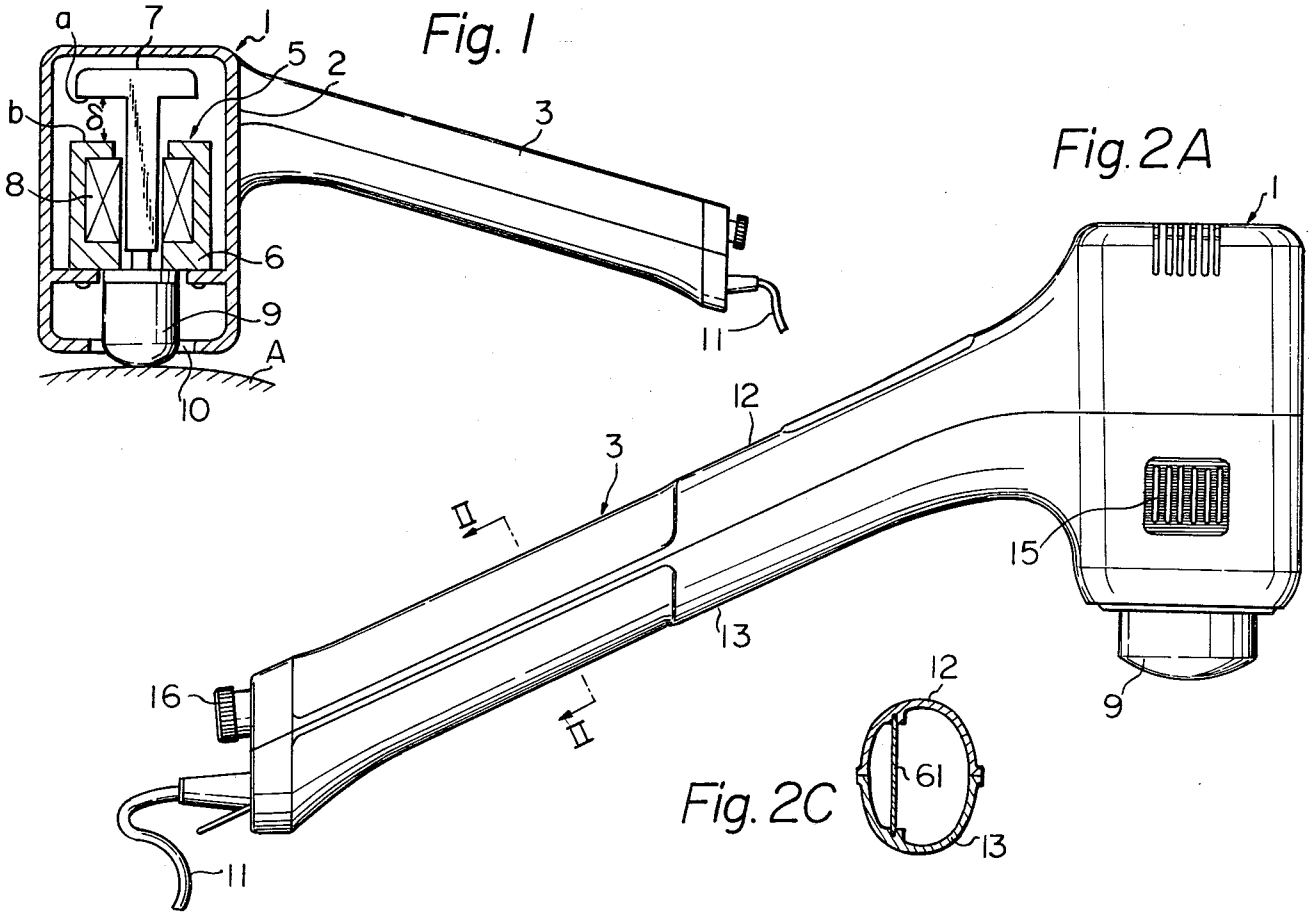
FIG. 1 is a schematic explanatory view for explaining the operation of a shoulder patting instrument embodying the present invention with its major part sectioned.
FIG. 2A is an elevation of a most preferable embodiment of the shoulder patting instrument of the present invention.
FIG. 2C is a sectioned view of a gripping part of the same on line II — II.

Referring to general idea of the shoulder patting instrument of the present invention with reference to FIG. 1, a housing 2 and a gripping part 3 are integrally connected with each other, an iron core 6 of an electromagnet 5 is fixed to an inside wall of the housing 2 and a plunger 7 of a magnetic material is provided axially movably within said core 6. A coil winding 8 is disposed in the core 6, so that the core 6 and coil 8 will form a stationary part of the electromagnet 5. A patting instrument 9 of a soft or resilient material is fitted to an end of the plunger 7 projecting out of the housing 2 in lower side thereof in the drawing showing the position of the instrument in actual use. An opening 10 is made in the lower end of the housing 2 for allowing the plunger attachment 9 to be freely movable through the housing 2. A conductive wire cord 11 for connecting a controlling means of the electromagnet to a commercial electric source is led out of an end of the gripping 3.

The operation of the shoulder patting instrument shown in FIG. 1 shall be explained in the following.

The illustrated state is a de-energized state in which no current is flowing through the coil 8 of the electromagnet 5. In the illustrated state, the shoulder patting instrument of the present invention is placed vertically on a shoulder A of the user. When an electric current is then made to flow through the coil 8, the plunger 7 will be attracted in the head part to the core 6 downward so that the lower surface *a* of the head part of the plunger 7 may contact the upper surface *b* of the core 6 and thus the plunger 7 will move by a stroke $\delta$ but, as the attachment 9 in the lower part of the plunger is butted against the user's shoulder A, practically the stationary part of the electromagnet is to be caused to move upward, that is, a head part 1 of the instrument including the core, coil and housing 2 will rise relatively with respect to the plunger 7. When the current flowing through the coil 8 is interrupted, the magnetic attraction to the plunger 7 of the core 6 will vanish and, therefore, the electromagnet's stationary part will drop, so as to hit upon the attachment 9 and pat the shoulder with the entire weight of the head part 1 and the attraction reaction of the electromagnet. Thus, by intermittently switching ON and OFF the current flowing through the coil 8, the shoulder can be continuously patted.

Figure 2B:
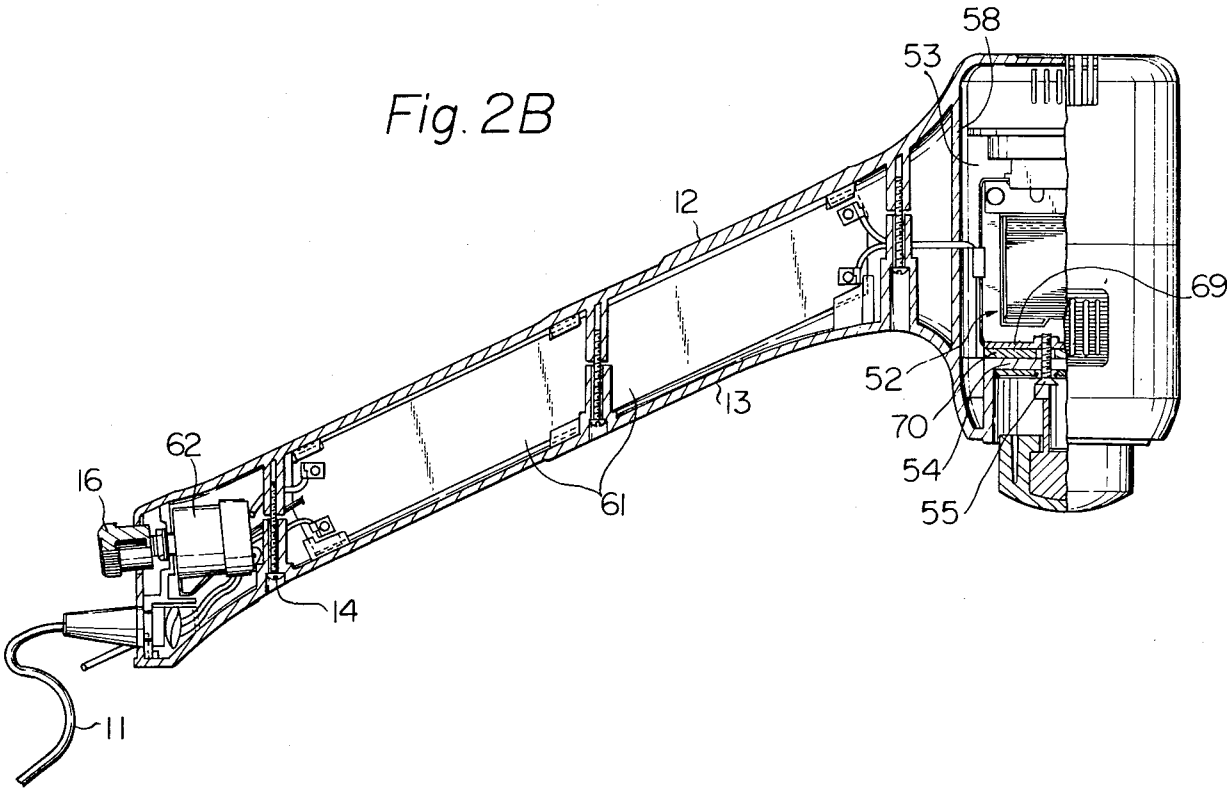
FIG. 2B is a vertically sectioned view of the instrument shown in FIG. 2A in electromagnetically energized state.

In the most preferable embodiment in FIGS. 2A and 2B of the instrument of the present invention, the head part 1 and gripping part 3 are formed of an upper case 12 and lower case 13 both made of a plastic material, said upper and lower cases 12 and 13 are overlapped on each other and coupled together by screws 14. The gripping part 3 is noncircular in the cross-section and extends diagonally from the head (see FIG. 2C). Projecting below the head part 1 is the patting attachment 9. In the head part 1, there are provided ventilating apertures 15 for cooling the electromagnet housed in the head part and controlled by means of a knob 16 positioned at extended end of the gripping part 3.

Figure 3:
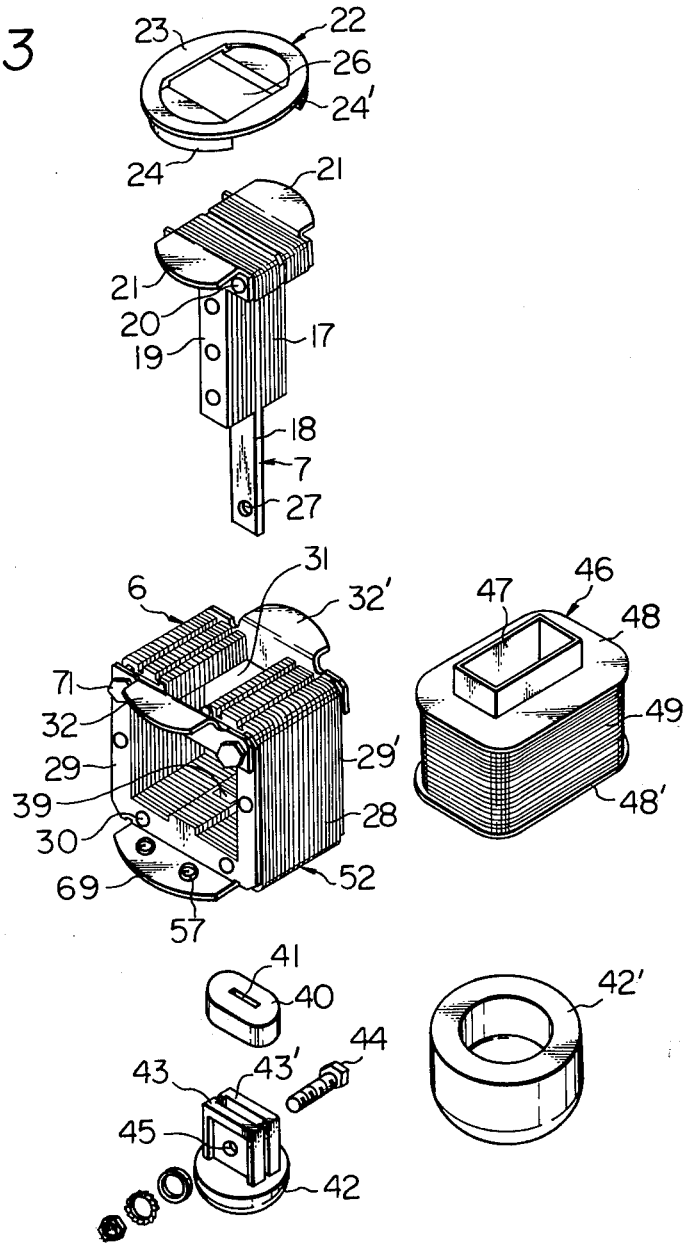
FIG. 3 is a perspective view of an electromagnet employed in the instrument shown in FIG. 2, as disassembled.

Referring to the electromagnet shown in FIG. 3 showing the same as disassembled, the plunger 7 is formed by piling up thin T-shaped core members 17 to be of any desired thickness of each side of a driving rod 8 made in a similar T-shape but having a longer extended leg, overlapping a likewise T-shaped pressing plate 19 on each outer side and integrally coupling them together by rivets 20. Further, an outward bent part 21 is formed in the upper part of said pressing plate 19 and an upper elastic plate 22 is fitted on these bent parts 21.

Figure 4A:
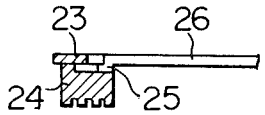
FIG. 4A is a sectioned view of an upper elastic plate of the shoulder patting instrument of FIG. 2.
Figure 4B:
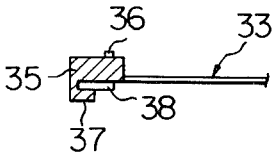
FIG. 4B is a sectioned view of a lower elastic plate of the instrument of FIG. 2.
Figure 4C:
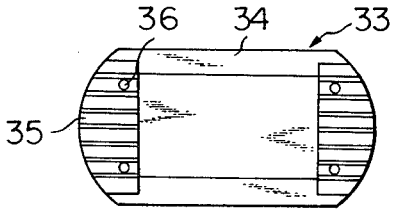
FIG. 4C is an upper plan view of the lower elastic plate shown in FIG. 4B.

The upper elastic plate 22 comprises a substantially disk-shaped body 23 which is made of rubber and provided with contact parts 24 and 24' projecting from the lower surfaces at both sides and with spaces 25 for allowing the bent parts 21 of the respective pressing plates 19 to be inserted therein (see FIG. 4A). An aperture 26 is further made in the body 23. The size of this elastic plate 22 is made to have a slight clearance from the inner wall of the housing 2 when the electromagnet is fitted within the housing. This upper elastic plate 22 is fitted to the upper part of the plunger 7 by passing the aperture 26 of the elastic plate 22 from below the plunger 7, inserting the bent parts 21 of the respective pressing plates 19 outside the plunger 7 into the respective spaces 25 of the upper elastic plate 22 and bonding the pressing plates 19 to the upper elastic plate 22 with a binder. A hole 27 for mounting the attachment is made in the lower part of the driving rod 18 of the plunger 7.

Figure 4D:
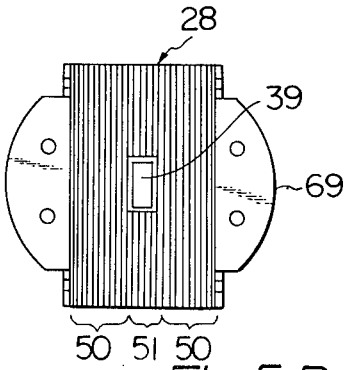
FIG. 4D is a lower plan view of stationary part of the electromagnet of FIG. 3.
Figure 5A:
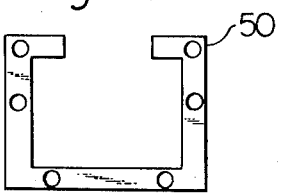
FIGS. 5A and 5B are plan views showing the shapes of respective core members used in both side parts and middle part in a core used in the electromagnet shown in FIG. 3.
Figure 5B:
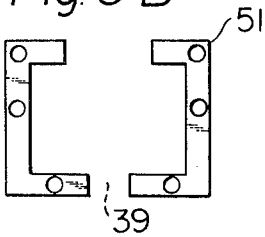

The core 6 is formed by piling up thin U-shaped core members 28 to be of any desired thickness, pressing them on both sides with respective U-shaped pressing plates 29 and 29' and integrally joining them by means of rivets 30. In this case, a through hole 31 through which the plunger 7 is to move vertically is formed in the center of the core and a small hole 39 through which only the driving rod 18 of the plunger 7 is to pass is formed in the bottom part of said through hole 31 as shown best in FIG. 4D. Therefore, U-shaped core members 51 shown in FIG. 5B are piled up to be of a thickness a little larger than the thickness of the driving rod 18 of the plunger 7 in the center of the core 6 while core members 50 shown in FIG. 5A are piled up to be of any desired thickness of the core on both sides of these piled up members 51 to form the core.

A coil bobbin 46 of an insulative material is formed to have a body 47 which having a rectangular space formed in the center so as to allow the iron core part of the plunger 7 to freely move therethrough and flanges 48 and 48' formed a little away respectively from the upper end and lower end of the body 47, and a coil 49 is wound between these flanges 48 and 48'. The bobbin 46 and iron core 6 are integrally formed by piling up such core members 50 as are shown in FIG. 5A on both sides of the body 47 of the bobbin 46 to hold it, further piling up the core members 51 shown in FIG. 5B, butting L-shaped fitting plates 32 and 32' against both sides of the piled up core members and fastening thus obtained assembly with a plurality of rivets. Further, the fitting plates 32 and 32' are fixed to both sides of the upper part of the core 6 with screws 71 and nuts, and a lower elastic plate 33 is fitted to upper horizontal parts extending in the direction at right angles with respect to the through hole 31 of the core 6 above the fitting plates 32 and 32' (see FIGS. 4 and 6). The lower elastic plate 33 is formed of a rubbery material to have cushioning parts 35 at positions above both sides of a frame-shaped body 34, small circular projections 36 on the cushioning parts 35 and engaging parts 37 below both sides of the body 34. Recesses 38 for receiving therein the horizontal parts of the respective fitting plates 32 and 32' are made in the engaging parts 37. This lower elastic plate 33 is fitted to the core 6 and fitting plates 32 and 32' by expanding the lower elastic plate 33, fitting its recesses 38 to the horizontal parts of the respective fitting plates 32 and 32' and bonding the lower elastic plate 33 and fitting plates 32, 32' with a binder.

The pressing plate 29 and 29' are respectively provided with a lower bent part 69 which is bent outward and has screw holes 57 to fix it to the lower case 13. A substantially elliptic shaped elastic body 40 is fitted to the driving rod 18 of the plunger 7 exposed out of the core 6, passing the rod through an axial hole 41 in the body 40.

An attachment 42 is provided with two engaging plates 43 and 43' erected on the same at a spacing in which the driving rod 18 of the plunger 7 is to be inserted. A screw 44 is to be inserted through holes 45 made in the engaging plates 43 and 43' and also the hole 27 of the driving rod 18 to secure the attachment 42 to the driving rod 18.

Figure 6A:
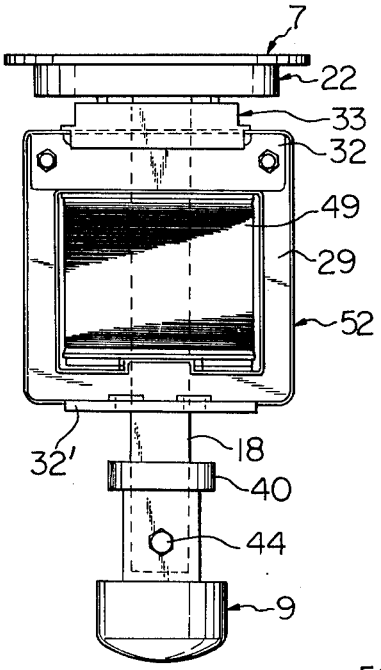
FIG. 6A is an elevation of an assembly of the electromagnet shown in FIG. 3 in its energized state.
Figure 6B:
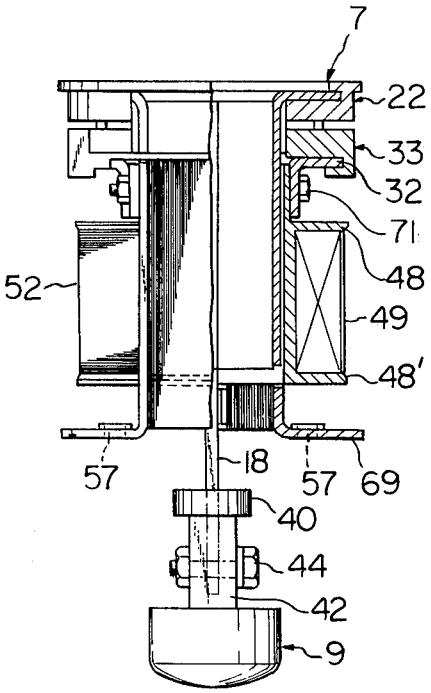
FIG. 6B is a partly sectioned side view of the assembly shown in FIG. 6A.

In assembling the above described electromagnet, the upper elastic plate 22 is first fitted to the upper part of the plunger 7, the lower elastic plate 33 is fitted next to the upper part of the core 6, the driving rod 18 of the plunger 7 is inserted into the stationary electromagnet part 52 and is projected downward through the hole 39, the elastic body 40 is fitted and the attachment 42 is fitted to the lower end of the driving rod 18. A rubber cover 42' is fitted to said attachment 42 to form the attachment member 9. The assembly of this electromagnet is shown in FIGS. 6A and 6B and this assembly comprises the stationary electromagnet part 52 and plunger 7.

Figure 7A:
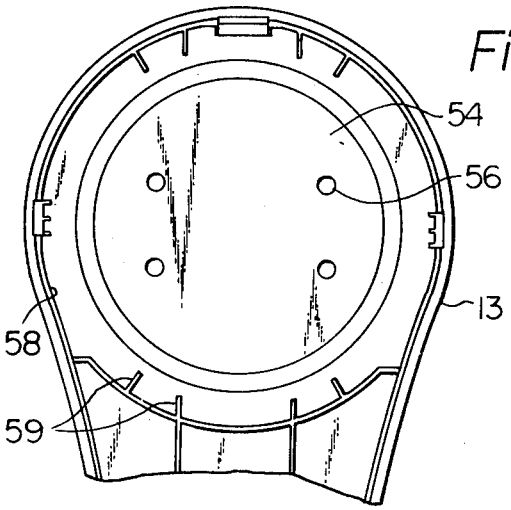
Figure 7B:
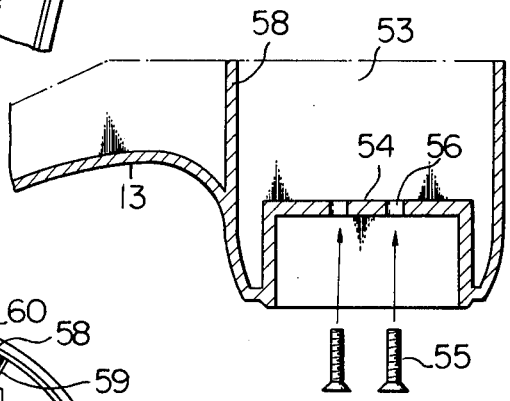
Figure 7C:
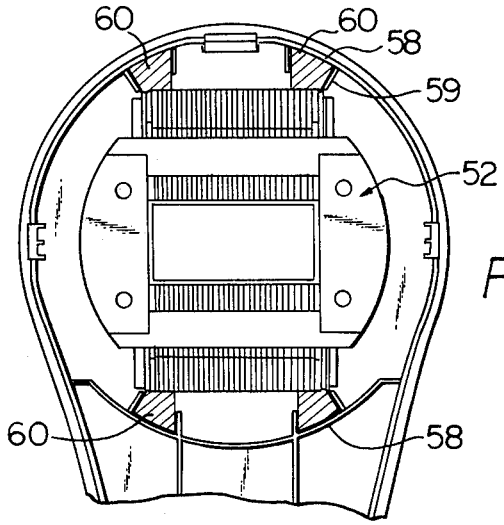

Now, in fitting said electromagnet to the lower case 13, in FIGS. 7A to 7C, the stationary electromagnet part 52 is inserted into a space 53 provided in the lower case 13, the bottom part of the electromagnet is mounted to a bottom plate 54 provided within the lower case 13 through an elastic plate 70 (see FIG. 2B), screws 55 are inserted through holes 56 in the bottom plate 54 and are screwed and secured in the screw holes 57 provided in the bent parts 69 on the lower surfaces of the pressing plates 29 of the stationary electromagnet part 52 and bar-shaped rubber bodies 60 are inserted between the side wall of the stationary electromagnet part 52 and the inside wall 58 of the space 53 and between partition walls 59 provided within the space to fix the stationary electromagnet part 52 within the space 53 of the lower case 13.

In FIG. 2B, a circuit controlling means (an electric circuit) 61 is housed in a space within the gripping part 3 formed of the upper case 12 and lower case 13 and a combined controlling switch and variable resistor means 62 is fixed at the left end, which means is manually operated by a knob 16 exposed endwise.

Figure 8A:
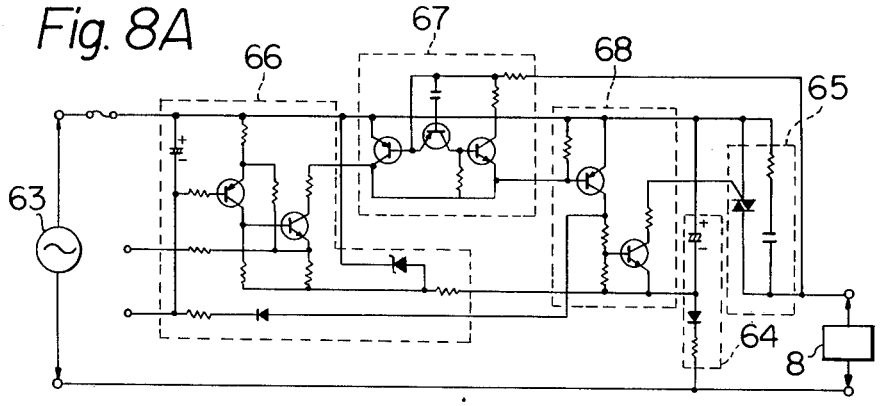
FIG. 8A is a circuit diagram of a controlling section of the shoulder patting instrument of the present invention.

FIG. 8A shows an electric circuit, that is, a circuit diagram for controlling the electric current flowing through the coil of the electromagnet to attract or release the plunger. In the drawing, the voltage of a commercial alternating current source 63 is rectified by a rectifying circuit 64 and is given to a series circuit of a coil 8 of an electromagnet and a bi-directional three-terminal thylistor 65, and a timer 66 oscillates periodically to detect a zero phase of the voltage of the alternating current source, operates a driving circuit 68 from this zero phase and switches the thylistor ON and OFF.

Figure 8B:
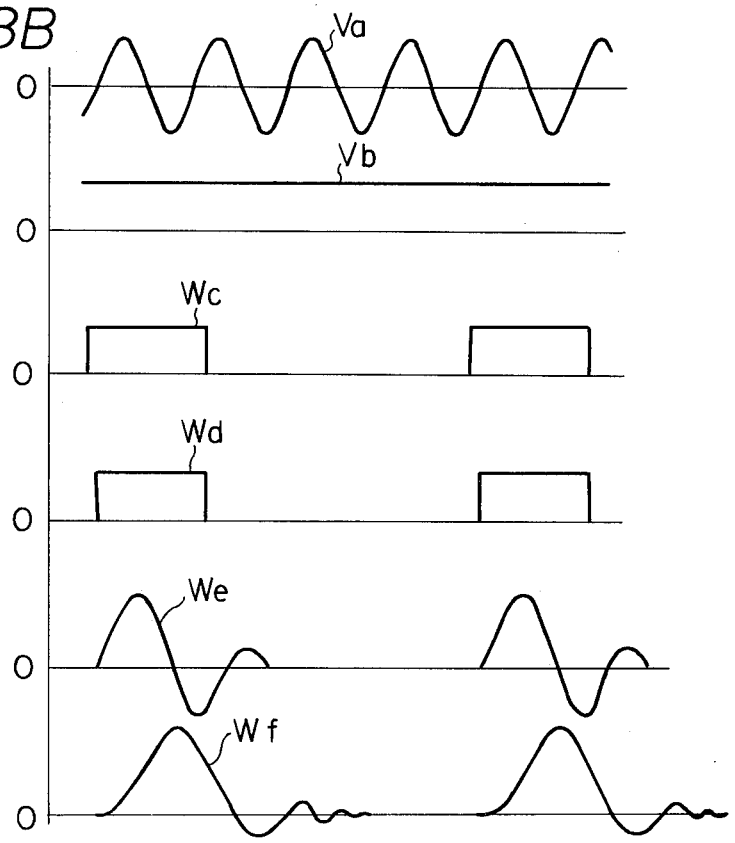
FIG. 8B is a diagram showing voltage and current wave forms at respective parts of the controlling section and attraction wave forms of the electromagnet causing the shoulder patting.

In FIG. 8B showing voltage and current wave forms at respective parts of the circuit of FIG. 8A, V*a* represents a voltage of the alternating current source, V*b* represents a rectified voltage, W*c* represents an output wave form of the timer circuit 66, W*d* represents a wave form of the driving circuit 68, W*e* represents an electric current flowing through the coil 8 through the thylistor 65 and W*f* represents an attraction wave form of the electromagnet causing the shoulder patting operation.

The use and operation of the instrument of the present invention shall be explained in the following.

Now, when the gripping part 3 is gripped by hand, the attachment 9 is brought into contact with such part to be patted as a shoulder while placing the head part 1 of the instrument on the part substantially vertically and the knob 16 is pulled to set the switch ON, a pulse current will be made to flow through the coil 8 of the electromagnet by the controlling section and, therefore, the electromagnet will be made to intermittently attract the plunger 7 in the upper part of the same by this pulse current, whereby the weight of the electromagnet 5 will be applied intermittently to the user's body part to be patting treated through the attachment 9 to carry out the patting operation. In such case, as the current is passed from the zero phase of the voltage of the alternating current source, the same attracting force will act on the electromagnet 5 each time so that a uniform shoulder patting effect can be obtained.

The present invention has such features as in the following.

In the operation of the present invention, as described above, when the plunger is attracted by the electromagnet and the electromagnet is de-energized, the body part to be treated will be patted with the weight of the stationary electromagnet part comprising the core, coil, upper case and lower case and also with the attraction reaction of the electromagnet. Therefore, even if a small electromagnet is used, large impact forces will be able to be given.

Further, the effect of giving larger impact forces is added by arranging the light electric components in the gripping part and arranging the heavy components of the electromagnet in the head part.

Generally, in an electromagnet, when the plunger is attracted, an impact sound will be generated. However, according to the present invention, as elastic plates are fitted respectively to the upper part of the plunger and the upper part of the stationary electromagnet part, the impact sound can be absorbed by such sound preventing rubber. Further, when the plunger is relieved of the attraction, the attachment will butt on the core through the elastic body 40. Therefore, the impact sound in such case can be also absorbed.

In fixing the electromagnet to the lower case of the housing, it is fitted to the bottom plate 54 of the lower case 13 through the elastic plate 70 and the elastic bodies 60 are interposed between it and the side wall of the lower case 13. Therefore, the slightest vibration at the time of energizing the electromagnet can be absorbed.

Further, according to the present invention, by adjusting the resistor 62, the oscillation period of the timer 66 can be adjusted and therefore the shoulder patting velocity can be freely adjusted.

According to the present invention, as the diameter of the upper elastic plate 22 fitted to the upper part of the plunger is made larger, the air in the spaces within the upper case and lower case is moved due to the vertical motion of the plunger air can be accelerated to come in and out through the through holes 15 provided on the side walls of the upper case 12 and lower case 13. Therefore, there is a positive effect of cooling the electromagnet.

Further according to the present invention, as the gripping part is formed as extended diagonally downward from the head part so as to provide a fixed angle with respect to an axis perpendicular to the moving direction of the plunger, the user's shoulder and back can be easily patted with the attachment by the user alone. Further, as the gripping part is noncircular, the user's placing control of the head part for achieving the substantially vertical butting of the attachment to the body part to be treated can be easily performed by properly rotating such noncircular gripping part by hand.

While in the foregoing descriptions of the preferred embodiment illustrated it has been set forth that, when the coil of the electromagnet is de-energized, the core abuts at the side on which it is fixed to the housing against the treating attachment on the plunger, specifically as hitting the attachment through the elastic body 40, so as to give the patting treatment to the user's body with the entire weight of the head part of the instrument, it should be appreciated that such transmission of the head part weight to the attachment upon falling down of the head part due to the de-energization may not be limited to the direct abutment of the attachment against the core, through the elastic body, but the transmission may be also performed by the abutment of the plunger's attachment rather against any other part of the stationary electromagnet part or any inner part of the housing, and that it is even possible to perform the transmission by an abutment of the housing 2 against the upper part having the elastic plate 22 of the plunger 7 through a proper cushioning means as long as the housing 2 is prepared strong enough for given impact.

What we claim as our invention is:

1. In a shoulder patting instrument, the combination comprising a housing having an aperture formed therein and including a handle on one side thereof, an electromagnet having a relatively weighty stator and coil stationarily mounted within the housing and having a relatively lighter movable armature cooperating therewith movable between a retracted position and an energized position, a plunger fixed to the armature and generally centered with respect to the aperture in the housing, a pad on the end of the plunger projecting outwardly of the housing for pressing against a body surface upon guidance by the handle, means for applying pulses of current intermittently to the coil, the electromagnet being oriented so that when a pulse of current is applied to the coil the armature is attracted by the stator for thrusting of the plunger relatively outwardly with respect to the housing so that the housing and weighty stator are thrust relatively away from the body surface, the inertia of the stator and housing providing a reaction force which is applied by the plunger to the body in the form of a pat, the plunger being free upon cessation of current to return to its retracted position resulting in a slight bouncing movement of the stator and housing with respect to the body surface, resilient means interposed between the stator and armature for cushioning the movement of the armature into its energized position, the handle being elongated and extending generally perpendicularly to the direction of plunger movement and having a grip portion at the end thereof for pressing the instrument lightly against the body surface while accommodating the slight bouncing movement of the housing.

2. The combination as claimed in claim 1 in which the pad at the end of the plunger extends through the aperture in the housing and projects only a short distance from the housing when the armature is in its retracted position.

3. The combination as claimed in claim 1 in which the armature carries a diaphragm spanning the inner walls of the housing and which is reciprocated axially back and forth upon movement of the armature for pumping of air inwardly and outwardly of the housing thereby to cool the electromagnet.

4. The combination as claimed in claim 1 in which a pulse generator is provided having input terminals and output terminals, the input terminals being coupled to the AC supply line, the output terminals being connected to the coil, the pulse generator having means to generate pulses at a rate which is only a fraction of the frequency of the AC pulses on the supply line thereby permitting relatively long intermittent excursions of the armature.

* * * * *